US009437955B2

(12) United States Patent
Zaiser et al.

(10) Patent No.: US 9,437,955 B2
(45) Date of Patent: Sep. 6, 2016

(54) SEALED CONNECTOR AND METHOD OF SEALING A CONNECTOR

(71) Applicant: ROBERT BOSCH GmbH, Stuttgart (DE)

(72) Inventors: Liebhart Zaiser, Karlstadt (DE); Thomas Wenzler, Trossingen (DE)

(73) Assignee: ROBERT BOSCH GmbH, Stuttgart (DE)

( * ) Notice: Subject to any disclaimer, the term of this patent is extended or adjusted under 35 U.S.C. 154(b) by 443 days.

(21) Appl. No.: 13/736,580

(22) Filed: Jan. 8, 2013

(65) Prior Publication Data

US 2013/0189865 A1 Jul. 25, 2013

(30) Foreign Application Priority Data

Jan. 25, 2012 (DE) ..... 10 2012 100 598

(51) Int. Cl.
*H01R 13/52* (2006.01)
*H01R 43/00* (2006.01)
*H01R 13/405* (2006.01)

(52) U.S. Cl.
CPC ..... *H01R 13/52* (2013.01); *H01R 13/405* (2013.01); *H01R 13/5216* (2013.01); *H01R 43/005* (2013.01)

(58) Field of Classification Search
CPC ..... H01R 11/284; H01R 13/533
USPC ..... 439/936, 519
See application file for complete search history.

(56) References Cited

U.S. PATENT DOCUMENTS 4,115,356 A 9/1978 Hilliard
4,326,096 A * 4/1982 Leitmann ..... 174/84 R
4,645,278 A * 2/1987 Yevak et al. ..... 439/83
5,093,048 A * 3/1992 Kagan ..... B29C 45/14549 264/1.25
5,203,723 A 4/1993 Ritter
5,601,460 A * 2/1997 Shimirak et al. ..... 439/521
6,290,239 B1 * 9/2001 Yoshigi ..... 277/645
6,517,381 B2 * 2/2003 Kondo ..... H01R 11/12 439/604

(Continued)

FOREIGN PATENT DOCUMENTS

CN 101398321 A 4/2009
DE 1 148 613 5/1963

(Continued)

OTHER PUBLICATIONS

May 21, 2013 Extended European Search Report issued in European Patent Application No. EP 13 15 2448 (with translation).

(Continued)

*Primary Examiner* — Phuong Dinh
(74) *Attorney, Agent, or Firm* — Oliff PLC

(57) ABSTRACT

A connector for electrical supply of a unit of the hydraulics which can be arranged or is arranged at a casing of such unit. Thereby at least one current path penetrates a connector bottom of the connector and the connector bottom is sealed with a silicone-containing compound against penetrating moisture in an area of this passage. The compound is an adhesive having high adhesive forces. A casing of a unit of the hydraulics can include such connector. A method of sealing a connector bottom of a connector penetrated by a current path is disclosed via which connector a unit of the hydraulics is adapted to be electrically supplied, the method includes a step of sealing a passage of the current path through the connector bottom with silicone-containing adhesive.

13 Claims, 3 Drawing Sheets

(56) References Cited

U.S. PATENT DOCUMENTS

| | | | | |
|---|---|---|---|---|
| 6,579,125 | B1 * | 6/2003 | Nagahata | H01R 12/721 439/629 |
| 7,794,447 | B2 * | 9/2010 | Dann | A61F 2/04 604/514 |
| 8,084,698 | B2 * | 12/2011 | Belton | H01B 17/306 174/50.52 |
| 2009/0088020 | A1 * | 4/2009 | Abe et al. | 439/519 |
| 2009/0227127 | A1 * | 9/2009 | Kim et al. | 439/78 |
| 2012/0149229 | A1 * | 6/2012 | Kearsley | A61M 1/127 439/339 |
| 2012/0252244 | A1 * | 10/2012 | Elkins et al. | 439/215 |

FOREIGN PATENT DOCUMENTS

| | | | |
|---|---|---|---|
| DE | 44 10 455 | C1 | 6/1995 |
| DE | 10 2004 005 157 | A1 | 8/2005 |
| EP | 0 332 181 | A2 | 9/1989 |
| EP | 0961360 | A1 | 12/1999 |
| EP | 1265319 | A1 | 12/2002 |
| EP | 2 043 200 | A2 | 4/2009 |
| JP | 2009-016064 | A | 1/2009 |
| WO | WO 2004/084358 | A1 | 9/2004 |

OTHER PUBLICATIONS

Sep. 28, 2015 Office Action issued in Chinese Patent Application No. 201310079424.7.

May 9, 2016 Office Action issued in European Patent Application No. 13152448.0.

May 25, 2016 Office Action issued in Chinese Patent Application No. 201310079424.7.

* cited by examiner

SEALED CONNECTOR AND METHOD OF SEALING A CONNECTOR

BACKGROUND

The invention relates to a sealed connector in accordance with the preamble of claim 1 and a method of sealing a connector in accordance with the preamble of claim 13.

Control elements of the hydraulics, for example valves, can be actuated electromagnetically. For this purpose the valve includes an encapsulated solenoid having a coil via the current feed of which an armature is moved that entrains a valve piston. In this way a position of the valve piston can be precisely adjusted. For the current supply of the coil a connector penetrating the casing which is preferably made of plastic material and is injection-molded to the casing is provided at the casing of the solenoid. Current paths or pins of the connector connectable to a power source pass through a connector bottom of the connector from an outside toward an inside of the casing where they are connected to the coil.

It is known to pot the connector bottom of the connector with a dielectric sealing compound so as to seal the passage of the current paths against penetrating moisture. To this end, usually plastic materials, epoxy resin or silicone rubber is utilized.

The document DE 1 148 613 dating from 1963 recommends as a sealing compound for the connector a silicone to be potted which is intended to adhere to the contacted materials. Alternatively, tacky petroleum compounds or rubber or epoxy compounds are suggested.

It is a drawback of the suggested solutions that the substances suggested as sealing compound are not specified. It is a drawback of the suggested epoxy compounds that especially in the case of load due to temperature variations they are subjected to shrinking which may result in a detachment and thus in leakage at a boundary layer between the pin and the sealing compound.

The document DE 44 10 455 C1 dating from 1995 takes up the recommendation of using an adherent silicone and mentions the use of a two-component UV-hardening silicone. However, the document advises against this concept, as in the case of mechanical load of the silicone, especially in the case of movement of the contact pins, the adhesiveness of the silicone gets lost. Instead a solution is suggested in which the tightness is obtained by a specific geometric design of the pins and a shrinking of the plastic material surrounding the pins during cooling of the plastic material in the manufacturing process.

It is a drawback of the solution without any sealing compound that the plastic material surrounding the pins is subjected to shrinking during its lifetime. Furthermore, the plastic material is only little elastic so that with this solution, too, leakage of the passage can occur in the case of recurring mechanical loads or in the case of load due to temperature variations.

Compared to this, the object underlying the invention is to provide a connector having improved tightness against penetrating moisture.

This object is achieved by a sealed connector comprising the features of claim 1 as well as by a method of sealing a connector comprising the features of claim 13.

BRIEF SUMMARY OF THE INVENTION

Advantageous developments of the invention are described in the dependent claims.

The connector according to the invention for the electric supply of a unit of the hydraulics can be disposed at a casing of said unit. Thereby a connector bottom of the connector is penetrated by at least one current path. Said passage of the at least one current path through the connector bottom is sealed with a silicone-containing compound. In accordance with the invention, said compound is an adhesive and exhibits high adhesiveness. This strong adhesion can ensure that in detrimental operating conditions in which the current path is moved the sealing compound continues adhering to the current path. In this way detachment from the current path, i.e. formation of a gap between the current path and the sealing compound is prevented. Thus sustained sealing of the unit against moisture can be brought about. In connection with the high adhesiveness of the compound and the adhesive, respectively, the adhesive is preferred to exhibit high flexibility. In this way sticking of the adhesive to the current path is further improved. It is another advantage of the adhesive used that, in the case of load of the connector due to temperature variations resulting in tensions in the area of the boundary layer between the current path and the adhesive due to different temperature expansion coefficients of the sealing compound which is the adhesive and the current path, the tightness of the connector continues to be maintained.

The connector bottom is understood to be an area of a casing of the connector which is penetrated by a current path.

The unit is preferably connectable via the connector to a power source or an electric control unit. In an especially preferred manner the unit is a coil of a solenoid or an equipment cabinet. Thereby it is preferred when a valve, especially a pilot valve of mobile hydraulics, is operable via the solenoid.

In an advantageous development of the connector the connector bottom of the connector is potted with the adhesive at least in an area of passage of the at least one current path. Potting involves low efforts in terms of manufacturing, whereby the sealing can be manufactured in an inexpensive manner.

In the case of connectors having larger manufacturing tolerances and consequently including a gap between the at least one current path and the connector bottom, especially an annular gap or a clearance, the silicone-containing adhesive turns out to be very advantageous, because due to its low surface energy it penetrates even a very narrow gap so that the latter is potted or filled, resp., with the adhesive in a sealing manner.

In an especially preferred development of the connector the adhesive consists of one component which constitutes a reduction of efforts vis-à-vis a use of two-component or multi-component adhesives or adhesives including a catalyst.

For this purpose an acetoxy adhesive having an acetoxy group at least in the non-hardened condition is especially suited.

In an especially preferred variant of the adhesive, the latter is light-hardened, particularly UV-light hardened. Alternatively or in addition, the adhesive can be humidity-hardened. In an especially preferred manner, the adhesive is primarily light or UV-light hardened and secondarily humidity hardened.

In a preferred variant of the connector the adhesive is ductile or viscous in an area close to the connector bottom, i.e. close to the passage of the current path through the connector bottom and the connector casing, respectively. Thus the sealing adhesive there has higher elasticity and moreover is more adhesive. These characteristics can be achieved, for example, by the fact that the adhesive is not fully hardened in this area.

In an especially advantageous development of the connector an insulating resistance has a value of more than 0.5 MO (mega-ohm) via the sealed passage of the at least one current path when a voltage of 500 Volt is applied. In an especially preferred manner, this value amounts to approximately 1 MO.

In an especially advantageous development of the connector a coil winding is arranged at the same so as to enable, in terms of apparatus, a particularly compact and space-saving arrangement of a coil of a solenoid.

It turns out to be especially advantageous when the connector according to the invention is disposed, in particular injection-molded, at a casing of a unit of the hydraulics for the electrical supply of the unit.

The unit preferably is a coil of a solenoid or an equipment cabinet, wherein preferably a valve, especially a pilot valve of the mobile hydraulics, is operable via the solenoid. The use of the casing in mobile hydraulics is especially advantageous, when the casing is exposed to varying operating states afloat and especially under water. This relates, for example, to mobile machines that are used for the rescue of individuals in flood protection. In this case electrically or electro-hydraulically operated valves or the solenoids thereof may happen to get under water. The tightness of the connectors thereof for power supply then is of crucial importance.

A method according to the invention for sealing a connector bottom of a connector penetrated by at least one current path and, respectively, for sealing a passage of the at least one current path through the connector bottom, wherein a unit of the hydraulics can be electrically supplied via the connector, includes the step of: sealing the passage with a silicone-containing adhesive. Thereby the sealing is preferably carried out by filling a gap formed in an area of the passage between the at least one current path and the connector bottom. This gap can especially be in the form of a clearance or an annular gap. The sealing or filling can be carried out especially by potting the connector bottom with the silicone-containing adhesive in the area of the passage of the at least one current path through the connector bottom.

The strong adhesion of the adhesive especially to the current path and a surface of the connector bottom and of the passage, resp., can ensure that in detrimental operating conditions in which the current path is moved the sealing compound of the adhesive continues adhering to the current path. In this way the adhesive is prevented from detaching from the current path and, resp., a gap is prevented from forming between the current path and the sealing compound. Thus the unit can be sealed in the area of the current path against penetration of moisture in a sustained manner. In connection with the high adhesive power of the adhesive the latter is preferred to exhibit high flexibility and elasticity. In this manner, the sticking of the adhesive to the current path is further improved. It is another advantage of the adhesive used that, in the case of load of the connector due to temperature variations resulting in tensions in the area of the boundary layer between the current path and the adhesive due to different temperature expansion coefficients of the sealing compound which is the adhesive and the current path, the tightness of the connector continues to be maintained.

Advantageously silicones are used as adhesive, as in the liquid state they have a low surface energy and therefore can optimally wet the connector bottom to be sealed and the current path to be sealed. Potting the connector bottom of the connector constitutes a step which in terms of procedure can be mastered very well. Thereby it has to be ensured, however, that the components of the current path and of the connector bottom to be glued or sealed are clean. The silicone-containing adhesive preferably consists of one component so as to keep procedural efforts low. Thereby the adhesive preferably includes an acetoxy group.

It is particularly advantageous when after sealing the passage of the at least one current path through the connector bottom with the silicone-containing adhesive as a further step the silicone-containing adhesive is hardened by light, especially by ultraviolet light.

Alternatively or in addition, the method according to the invention includes, after or during the step of hardening the silicone-containing adhesive by light, as a further step a hardening of the silicone-containing adhesive by humidity, in particular by air humidity or water vapor. This ensures that areas that cannot or could not be reached during light-hardening are hardened by the air humidity naturally occurring in the ambient air.

Hereinafter an embodiment of a connector according to the invention is illustrated in detail by way of the Figures, in which

DETAILED DESCRIPTION

Figure 1:
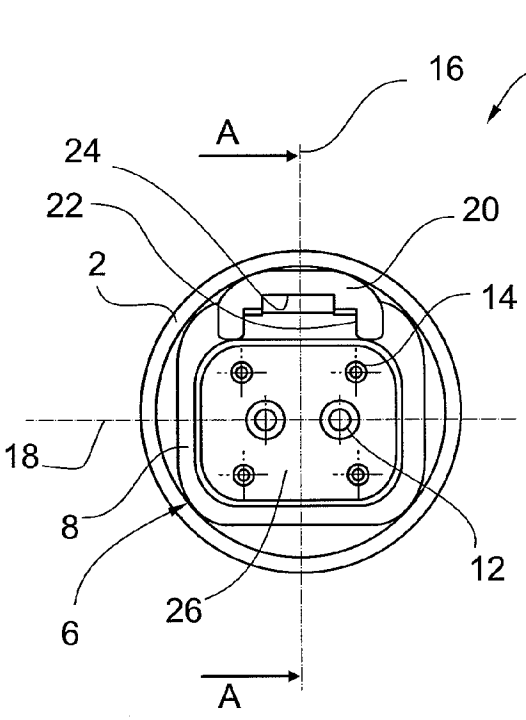
FIG. 1 shows a connector in a front view.

FIG. 1 shows a connector 1 for power supply of a coil of a solenoid (not shown) by which a pilot valve of the mobile hydraulics is controllable in a front view. The connector 1 is made of plastic material as an injection molded part. It has a substantially circular-cylindrical connector casing 2 provided for the arrangement in a corresponding breakout of a casing of the solenoid (not shown). The connector casing 2 has an end face 4 from which a connector device 6 extends toward the viewer of FIG. 1. The connector device 6 has an approximately rectangular connector collar 8 with rounded corners. Thereby the connector collar 8 borders a connector bottom 10 of the connector 1. In the area of the connector bottom 10 two current paths 12 in the form of pins and four smaller spacers 14 are disposed symmetrically with respect to a vertical axis 16 of the connector 1. Above a cross axis 18 extending through centers of the two current paths 12 an engaging carrier 20 is disposed at the connector collar 8. At its lower open side in FIG. 1 the engaging carrier 20 includes a guiding groove 22 which is further deepened on both sides of the vertical axis 16 in the direction of an upper side in FIG. 1 of the connector 1 and in this way forms an engaging groove 24. The connector bottom 10 of the connector 1 is filled with an adhesive 26 so that each of the spacers 14 and the current paths 12 is positively substance connected to the adhesive 26 by their radial outer shell surface.

Figure 2:
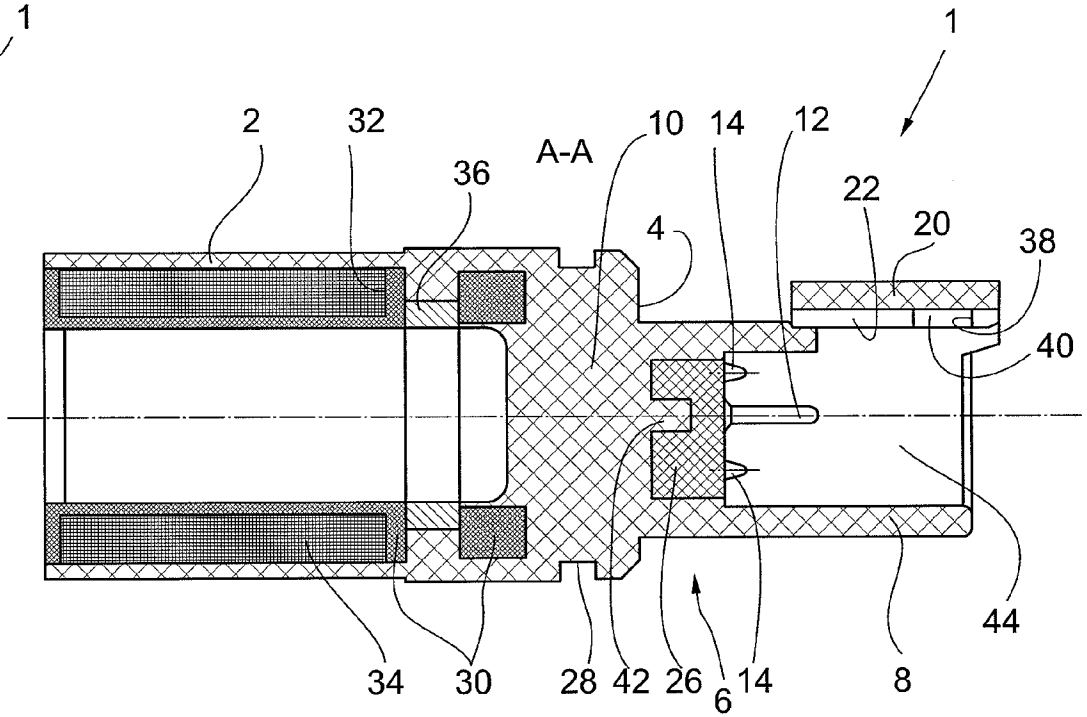
FIG. 2 shows the connector according to FIG. 1 in a longitudinal section.

FIG. 2 shows the embodiment of the connector according to FIG. 1 in a longitudinal section.

In FIG. 2 the connector 1 extends from the connector collar 8 on the right to the connector casing 2 disposed on the left. Approximately centrally there between the connector bottom 10 is arranged. At the radial periphery of the connector bottom 10 an O-ring groove 28 is formed which is provided for receiving an O-ring or seal ring (not shown). In a mounted state, i.e. when the connector 1 is fastened to a casing of the coil or of the solenoid (not shown), the connector 1 is arranged level with the connector bottom 10 and level with the O-ring groove 28, resp., at the casing. The casing is sealed with the connector 1 in a water-tight or moisture-tight manner via the O-ring.

The two current paths 12 penetrate the connector 1 and the connector bottom 10 thereof, resp., in FIG. 2 from the right to the left. By a left end portion of the current paths 12 not represented in FIG. 2 the latter immerse in a winding form 30. Said winding form 30 includes a radially outwardly opened winding groove 32 in which a coil winding 34 is accommodated. This coil winding 34 is connected to and, resp., contacted by the end portions of the current paths 12 indented in the plastic material of the winding form 30. Thus a current supply of the coil winding 37 is established via the current paths 12.

Radially inwardly at the connector casing 2 a pole disk 36 serving as magnetic return sheet for closing the magnetic circle is arranged.

At the right top in FIG. 2 the engaging carrier 20 is arranged by which a connector of the power source (not represented) is detachably connectable to the connector 1 and the connector device 6. To this end, the connector of the power source has to be introduced approximately coaxially into a connector holding fixture 44 bordered by the connector collar 8. This is done until one front side of the connector not shown abuts against the spacers 14 of the connector 1. The spacers 14 of the connector 1 are resiliently deformable in axial direction so that the connector not shown can penetrate farther and more deeply into the connector holding fixture 44 applying a particular force. In connection with an engaging lug of the connector not shown the engagement is effectuated when the engaging lug engages behind an engaging edge 38 of an engaging recess 40 of the engaging carrier 20. In this way the connector not shown can be fixed with a particular preload in the connector holding fixture 44. In the case of radial movements, for instance, of the connector not shown a transverse movement of the current paths 12 can occur due to transverse forces transmitted to the current paths 12. In order to limit this movement of the current paths 12 the connector bottom 10 of the connector 1 is extended by a base rib 42 on the right in FIG. 2. The latter has the function of clamping the current paths 12 penetrating the same. Thus a movement of the current paths 12 is inhibited to a certain extent.

In order to prevent moisture, for instance water or water vapor, acting from outside (on the right in FIG. 2) from passing from the connector holding fixture 44 through the connector bottom 10 penetrated by the current paths 12 to the coil winding 34, the connector bottom 10 enclosed by the connector collar 8 is filled with a silicone-containing adhesive 26. This is a one-component acetoxy silicone adhesive LOCTITE® 5091™ (Technical Data Sheet December 2007). The one-component form turns out to be advantageous during filling of the connector bottom 10, because no mixing with a second component or with a catalyst is required. Thereby the adhesive 26 hardens by UV light during the manufacturing process and after filling. In normal processing conditions already the adhesive 26 is exposed to sufficient UV radiation in order to completely harden at least on the surface. The adhesive 26 has another positive and advantageous characteristic, as it hardens by surface and/or air humidity even in shadow areas into which no UV radiation can reach. A complete hardening of the adhesive is reached after approximately 72 hours at ambient temperature. The adhesive 26 used is highly flexible whereby the adhesive spot has a shock-absorbing characteristic and a good load capacity. A transverse movement of the current paths 12 thus can be compensated well not only due to the adhesion of the adhesive 26 but also due to the elasticity of the adhesive 26. In this way the formation of a gap is effectively prevented at the boundary faces between the current paths 12 and the adhesive 26.

Figure 4:
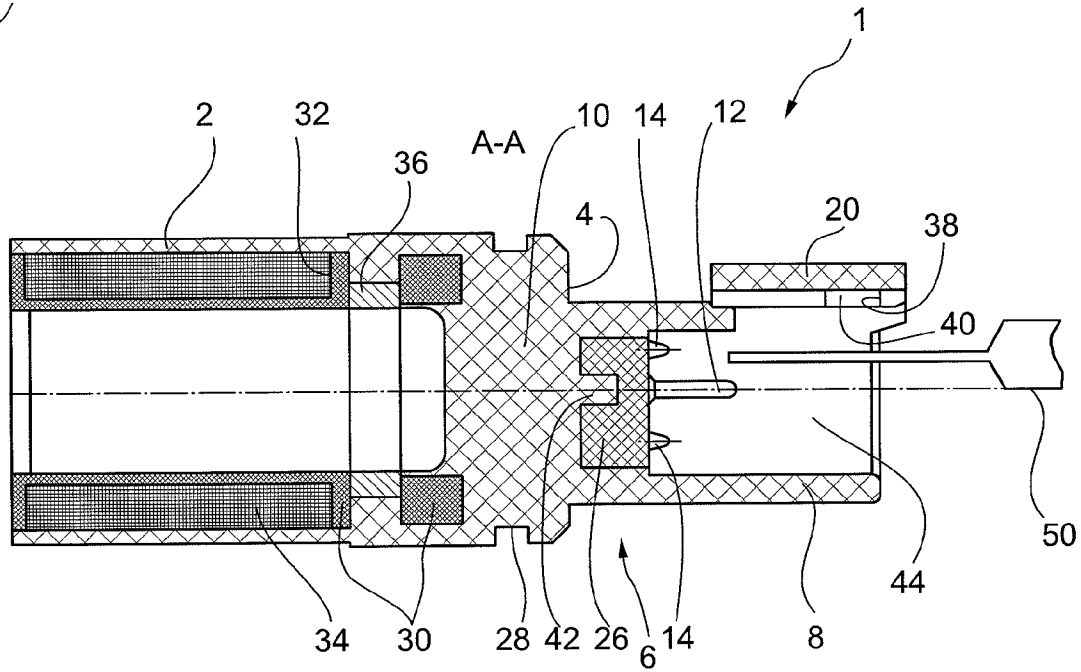
FIGS. 3 and 4 show the connector according to FIGS. 1 and 2 with a device for introducing the adhesive.
Figure 3:
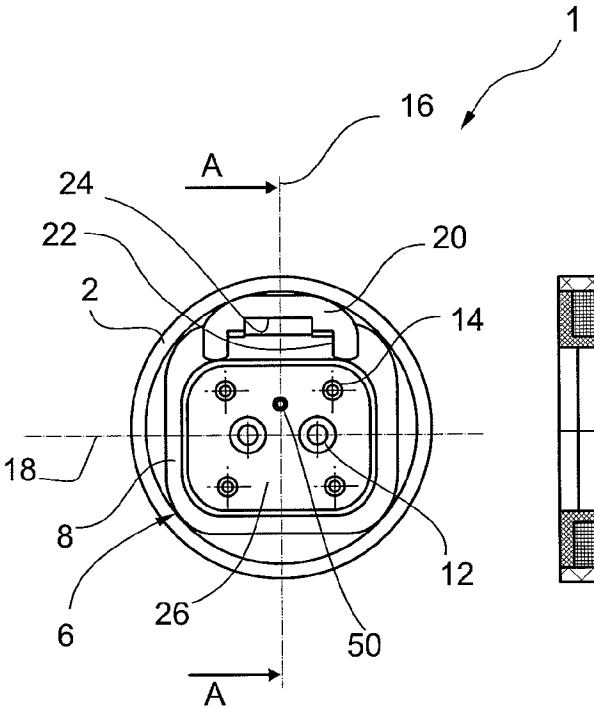

In FIGS. 3 and 4 a dosing device 50 preferably configured as dosing tip for dosed and exactly placed introduction of the liquid adhesive 26 into the passage area of the current paths 12 in the area of the connector bottom 10 is schematically represented. The dosing device 50 is introduced into the area of the connector holding fixture 44 with respect to its position so that a uniform filling of the clearance in the passage area of the current paths 12 is performed due to the amount and the flow characteristics of the adhesive 26 and a homogenous smooth surface of the adhesive 26 is formed toward the outside.

Figure 6:
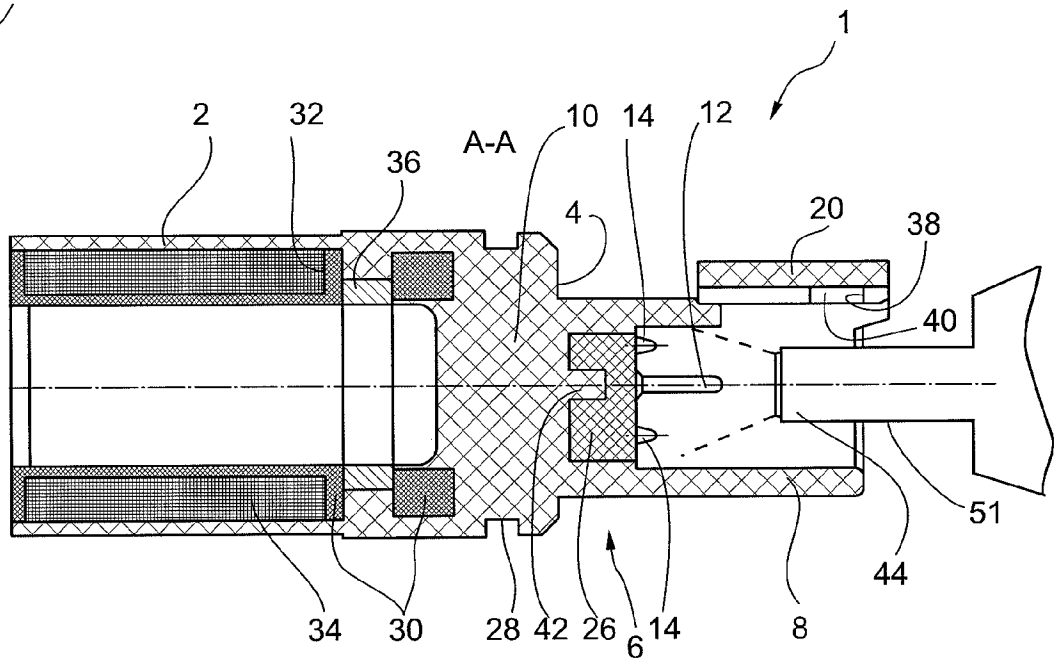
FIGS. 5 and 6 show the connector according to FIGS. 1 and 2 with a device for hardening the adhesive.
Figure 5:
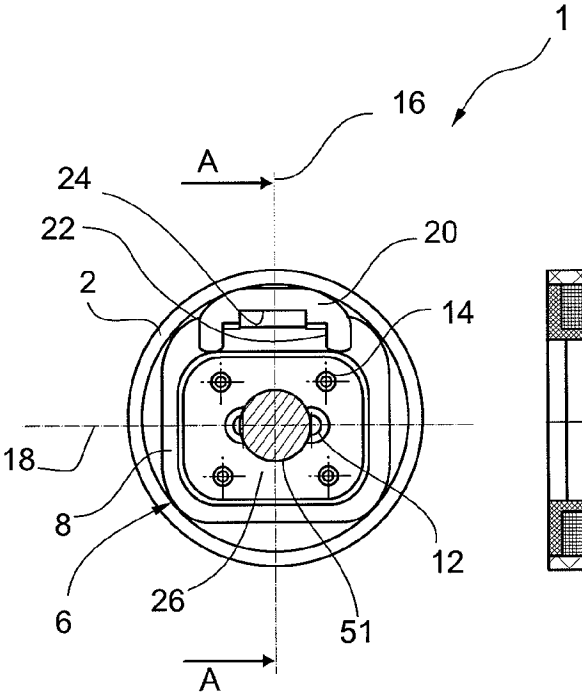

In FIGS. 5 and 6 a hardening device 51 preferably formed as UV light source for hardening the liquid adhesive 26 is schematically represented. The formation of a homogenous outer surface of the adhesive 26 is assisted by an appropriate dosed energy supply to the hardening device 51 so that the area filled by means of the adhesive 26 perfectly seals the connector 1 also to the outside and forms no gaps for later penetration of water during operation.

The adhesive 26 used exhibits advantageous and positive characteristics not only under the afore-mentioned mechanical loads but also under a load of the connector 1 due to temperature variations. This is demonstrated by load tests having the function of examining the tightness of the passage of the current paths 12 through the connector bottom 10. Thereby the connectors 1 heated to 140° C. in a climate-testing chamber by two hours' storage are abruptly immersed in cold water having a temperature of 20° C. There they were retained at a depth of one meter for a period of one hour. When subsequently storing the specimens in a climate-testing chamber and at 20° C. it was examined in how far water has passed from the connector holding fixture 44 to the other side of the connector 1 in the area of the winding form 30. Even after 20 cycles no leakage did occur. In each case an insulation resistance of the sealing adhesive 26 was higher than 1 MΩ. A leak current was lower than 10 μA at an applied voltage of 500 Volt.

Deviating from the use of the connector 1 for a coil of a solenoid of a pilot valve of the mobile hydraulics, the connector 1 according to the invention can advantageously be used wherever a water-tight feed-through of electric current paths or pins is required. The connector according to the invention turns out to be especially advantageous when it is used with pilot valves for mobile control blocks. In contrast to conventionally potted bottoms of connectors sealed with epoxy resin or Silopren compound, the connector according to the invention has definitely better characteristics of sealing at temperature variations and under mechanical load.

A connector for electrical supply of a unit of the hydraulics is disclosed which can be arranged or is arranged at a casing of such unit. Thereby a current path penetrates a connector bottom of the connector and in an area of this passage the connector bottom is sealed with a silicon-containing compound against penetrating moisture. In accordance with the invention, this compound is an adhesive having high adhesive forces.

There is further disclosed a casing of a unit of the hydraulics comprising such connector.

There is further disclosed a method of sealing a connector bottom of a connector penetrated by a current path by which connector a unit of the hydraulics can be electrically supplied. In accordance with the invention, the method includes a step of "sealing a passage of the current path through the connector bottom with a silicone-containing adhesive".

LIST OF REFERENCE NUMERALS

1 Connector
2 Connector casing
3 end face
6 connector device
8 connector collar
10 connector bottom
12 current path
14 spacer
16 vertical axis
18 cross axis
20 engaging carrier
22 guiding groove
24 engaging groove
26 adhesive
28 O-ring groove
30 winding body
32 winding groove
34 coil winding
36 pole disk
38 engaging edge
40 engagement
42 base rib
44 connector holding fixture
50 dosing device
51 hardening device

The invention claimed is:

1. A connector for electrical supply of a unit of the hydraulics adapted to be arranged at a casing of the unit, the connector comprising:

a connector bottom of the connector that is penetrated by at least one current path and a passage of the at least one current path is sealed with a silicone-containing compound, the compound being a silicone adhesive and being light-hardened, wherein in a finished product the silicone adhesive is ductile or viscous in an area close to the connector bottom to being not fully hardened in this area while being fully hardened in areas away from the connector bottom.

2. The connector according to claim 1, wherein the connector bottom is potted with the adhesive at least in an area of the passage of the at least one current path.

3. The connector according to claim 1, wherein a gap disposed between the at least one current path and the connector bottom is potted with the adhesive.

4. The connector according to claim 1, wherein the adhesive is a single-component adhesive.

5. The connector according to claim 1, wherein the adhesive is an acetoxy adhesive.

6. The connector according to claim 1, wherein the adhesive is additionally humidity-hardened.

7. The connector according to claim 1, wherein an insulating resistance via the sealed passage of the at least one current path is higher than 0.5 mega ohm (0.5 MΩ).

8. The connector according to claim 1, wherein the unit is a coil of a solenoid or an equipment cabinet.

9. The connector according to claim 8, wherein a valve is operable via the solenoid.

10. The connector according to claim 1, wherein a coil winding is arranged at the connector.

11. A casing of a unit of the hydraulics at which the connector according to claim 1 is arranged.

12. A method of sealing a passage of at least one current path through a connector bottom of a connector, wherein a unit of the hydraulics can be electrically supplied via the connector, the method comprising:

sealing the passage with a silicone-containing adhesive; and hardening the silicone-containing adhesive by light, wherein in a finished product the silicone-containing adhesive is ductile or viscous in an area close to the connector bottom to being not fully hardened in this area while being fully hardened in areas away from the connector bottom.

13. The method according to claim 12, wherein after or during hardening of the silicone-containing adhesive by light a step of hardening the silicone-containing adhesive by humidity is carried out.

* * * * *